US005147230A

United States Patent [19]

Plyler et al.

[11] Patent Number: 5,147,230

[45] Date of Patent: Sep. 15, 1992

[54] TWO PIECE ELECTRICAL FEMALE TERMINAL

[75] Inventors: Robert G. Plyler, Vienna; Bruce J. Serbin, Canfield; Bruce N. Sech, Cortland, all of Ohio

[73] Assignee: General Motors Corporation, Detroit, Mich.

[21] Appl. No.: 810,057

[22] Filed: Dec. 19, 1991

[51] Int. Cl.[5] ..... H01R 13/187

[52] U.S. Cl. ..... 439/843; 439/851

[58] Field of Search ..... 439/842–857, 439/861, 862, 885

[56] References Cited

U.S. PATENT DOCUMENTS

| | | | |
|---|---|---|---|
| 2,716,744 | 8/1955 | Swanson et al. | 339/262 |
| 3,003,135 | 10/1961 | Purinton | 339/262 |
| 3,123,429 | 3/1964 | Anderson et al. | 439/843 |
| 3,317,887 | 5/1967 | Henschen et al. | 339/256 |
| 4,184,736 | 1/1980 | Spaulding | 439/843 |
| 4,734,064 | 3/1988 | Knapp et al. | 439/852 |
| 4,921,456 | 5/1990 | French | 439/851 |
| 4,934,964 | 6/1990 | Mazelle | 439/843 |
| 4,946,402 | 8/1990 | Fink et al. | 439/274 |

FOREIGN PATENT DOCUMENTS

| | | | |
|---|---|---|---|
| 0313253 | 4/1989 | European Pat. Off. | 439/843 |
| 2032194 | 1/1972 | Fed. Rep. of Germany | 439/851 |
| 2516423 | 10/1976 | Fed. Rep. of Germany | 439/851 |

*Primary Examiner*—David L. Pirlot
*Attorney, Agent, or Firm*—Francis J. Fodale

[57] ABSTRACT

An electrical female terminal of two piece construction comprising a base terminal and a spring member. The base terminal is stamped and formed from a blank strip of relatively soft copper alloy and includes a round, smooth, protrusion-free contact end in the form of a rolled socket that is attached to conventional crimp wings by an intermediate cylindrical neck of a rolled cylindrical form. The rolled socket has an annular lip at its front end defining an entrance for plugging a terminal pin into the socket and a pair of contacts near the front end that are formed from the material of the socket. The spring member is stamped and bent from a sheet of spring material into a generally T-shaped configuration comprising a spring finger that is attached to the middle of a c-shaped support at one end. The spring member is located entirely inside the rolled socket by the deformed portions of the rolled socket in cooperation with the c-shaped collar so that the spring finger biases a terminal pin plugged into the rolled socket into engagement with the contact portions.

3 Claims, 1 Drawing Sheet

TWO PIECE ELECTRICAL FEMALE TERMINAL

BACKGROUND OF THE INVENTION

This invention relates generally to electrical female terminals and more specifically to electrical female terminals that can be used in sealed electrical connectors of the type disclosed in U.S. Pat. No. 4,946,402 granted to Randy L. Fink and Bruce J. Serbin Aug. 7, 1990.

This patent discloses an electrical connector that has an elastomeric seal that is mounted on the cable end of a connector body before the electrical female terminals are installed. These female terminals are attached to the ends of cables and then inserted into terminal cavities of the connector body through aligned holes in the elastomeric seal. The holes are sized to fit tightly around the cables when the female terminals are installed so as to seal the cable end of the electrical connector.

It is already known to provide electrical female terminals of two piece construction for such use comprising a terminal member and a protective can or hood. In these known female terminals, the terminal member has spring contact fingers at one end and crimp wings at the other end to attach the terminal member to the end of a cable. The protective can or hood surrounds the spring contact fingers to protect the fingers and to provide a round, protrusion free contact end that facilitates the female terminals being pushed through tight holes in the elastomeric seal during installation.

A problem associated with this known two piece female terminal is that the spring contact fingers and the crimp wings at opposite ends of the terminal member have diverse material property requirements, that is, a hard stiff material is desired for the spring fingers while a soft formable material is wanted for the crimp wings. Consequently, whatever material is chosen for the terminal member is a compromise that is not ideal for either the spring fingers or the crimp wings per se.

It is also known from U.S. Pat. No. 2,716,744 granted to George J. Swanson and Edward Kokalas Aug. 30, 1955 to provide a two piece electrical socket terminal comprising a body or socket member 10 and a spring contact member 11. The socket member 11 is a rigid copper alloy bar that is suitably drilled, machined and slotted to provide a bore 12 at one end for receiving a contact pin (not shown) and a recess 13 at the other end for receiving the end of a conductor (not shown) that is secured by soldering or other suitable means. The spring contact member 11 is blanked from a fully heat treated copper alloy sheet and formed to provide a collar portion 22 for mounting the spring contact member 11 on the socket member 10 and a spring finger 19 for biasing the contact pin against the wall of the bore 12.

This design permits the selection of different materials for the spring contact member 11 and the socket member 10 for attaching the terminal to a conductor or cable. However the design is not suitable for use in a sealed electrical connector of the type described above because of the external mounting of the spring contact member 11. In other words, the contact end of the socket member 10 is not round and protrusion free so as to facilitate pushing the terminal through a tight hole in an elastomeric seal without damaging the seal. Moreover the spring contact member 11 requires a relatively formable material because of the way it is fastened on the socket member 10.

It is also known from U.S. Pat. No. 3,317,887 granted to Homer Henschen and Marvin Yeager May 2, 1967 to provide a two-piece contact socket 2 comprising an outer tubular sleeve 4 and a cylindrical contact member 6 contained in the sleeve. Sleeve 4 has a wall that is relatively thick and may be formed of sheet metal construction. The sleeve 4 does not act primarily as a current carrying member so that it is made of a metal having an optimum balance of strength and crimping characteristics such as bronze or soft brass. The inner contact member is stamped and formed of a relatively thin sheet metal having good electrical properties and good spring properties such as beryllium copper.

This design has a round, protrusion free contact end so that the terminal could be inserted through a tight hole in an elastomeric seal without damaging the sealing qualities of the elastomeric seal. However, this design has substantially the same drawback as the first design discussed above because of the need for the inner contact member 6 that has diverse material property requirements for the spring portion and the crimp portion at its opposite ends.

SUMMARY OF THE INVENTION

The object of this invention is to provide an improved electrical female terminal of two-piece construction.

Another object of this invention is to provide an improved electrical female terminal that has a round, protrusion free contact end that allows the terminal to be plugged through a tight hole of an elastomeric seal without damage to the elastomeric seal.

A feature of the invention is that the electrical female terminal is of two piece construction with each piece including those parts of the terminal having substantially the same material property requirements.

Another feature of the invention is that the electrical female terminal is of two-piece construction with each piece being constructed of a material that suits the needs of that particular piece.

Still another feature of the invention is that the round, protrusion free contact end and the crimpable portion of the terminal are provided by the same piece of soft formable material.

Still another feature of the invention is that the same piece provides the electrical contact for the pin terminal as well as the means for crimping the terminal to the cable so that the electrical interfaces of the terminal are minimized.

Still yet another feature of the invention is that one piece has the singular function of providing the spring member so that it can be made of a material having optimum spring characteristics, such as stainless or spring steel.

Still yet another feature of the invention is that the spring member is a separate piece, that is, encapsulated in a contact end of another terminal piece so that the spring member does not have any exposed portion that can damage an elastomeric seal when the terminal is plugged through a tight hole in the elastomeric seal.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
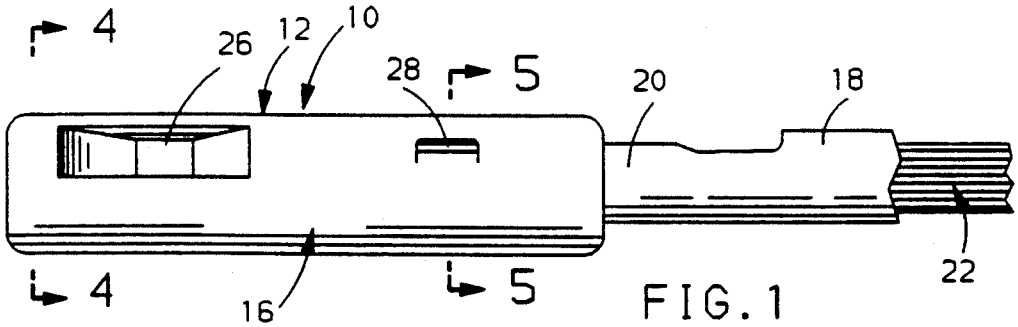
FIG. 1 is a longitudinal side view of an electrical female terminal in accordance with the invention.
Figure 2:
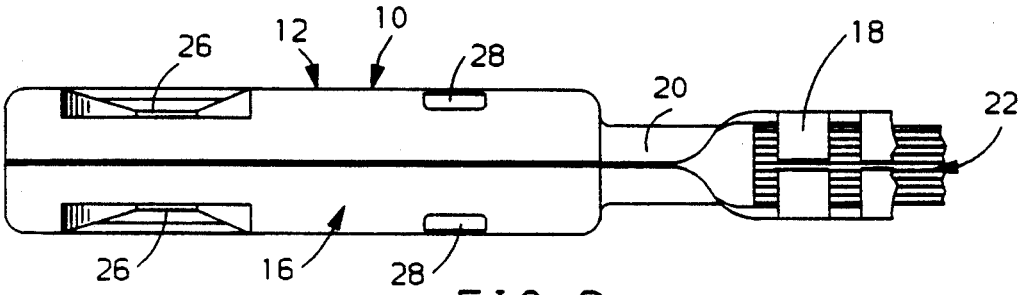
FIG. 2 is a longitudinal top view of the electrical female terminal shown in FIG. 1.

Referring now to the drawing the electrical female terminal 10 is of two piece construction comprising a base terminal 12 and a spring member 14.

The base terminal 12 is stamped and formed on a carrier strip using progressive and/or multi-slide die forming techniques on a blank strip of relatively soft copper alloy. It comprises a round, protrusion free contact end in the form of a rolled can or socket 16 that is attached to conventional crimp wings 18 by an intermediate cylindrical neck 20 that is also of a rolled cylindrical form. The crimp wings 18 are used to attach the terminal to an insulated electrical cable 22 and conventionally include core and insulation crimp wings that are crimped around a stripped end of the conductor core and the cable insulation jacket respectively. The crimp wings 18 and insulated cable 22 are only partially shown in favor of enlarging the rolled socket 16 and neck 20.

The rolled socket 16 includes a curled annular lip 24 at its front end that provides a smooth end to assist in plugging the female terminal 10 through a tight hole in an elastomeric seal without scoring or tearing the elastomeric seal.

Figure 3:
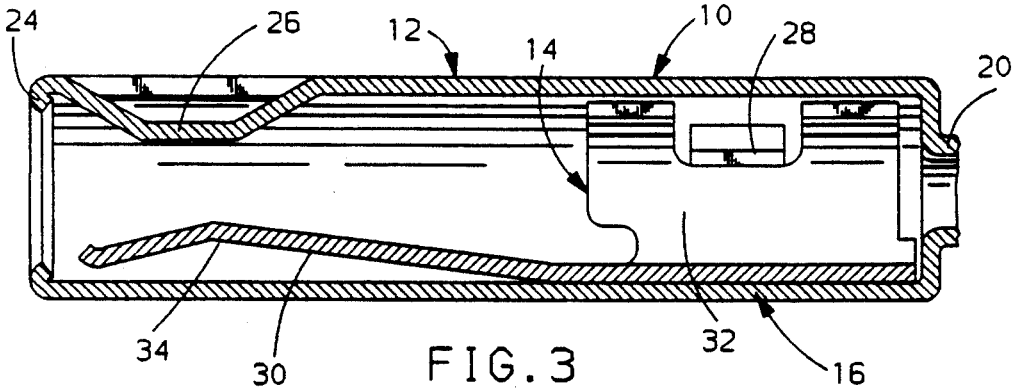
FIG. 3 is a longitudinal section of the electrical female terminal taken substantially along the line 3—3 of FIG. 4 looking in the direction of the arrows.
Figure 4:
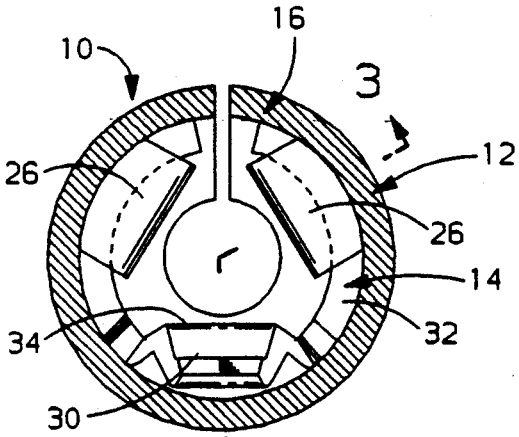
FIG. 4 is a transverse section of the electrical female terminal taken substantially along the line 4—4 of FIG. 1 looking in the direction of the arrows.

The rolled socket 16 also has a pair of longitudinal contacts 26 near the front end that are lanced from the material of the socket 16 and depressed inwardly in the form of simple beams that are integrally attached to the rolled socket 16 at each end. The depressed center sections of the longitudinal contacts lie radially inwardly of the annular lip 24 and are preferably flat as shown in FIGS. 3 and 4 to provide a substantial contact area for the mating terminal pins (not shown). The longitudinal contacts 26 are approximately 120 degrees apart in the circumferential direction and the seam of the rolled socket 16 is midway between them.

The rolled socket 16 further includes a pair of lanced tabs 28 in its rear portion. These lanced tabs 28 are bent inwardly to secure the spring member 14 in place as further explained below.

The spring member 14 is stamped and bent from a sheet of spring steel into a generally T-shaped configuration comprising a single spring finger 30 in the form of a cantilever beam that is attached to the middle of a C-shaped support 32. The spring finger 30 is bent into a shallow V-shape in the longitudinal direction having a raised apex 34 located radially inwardly of the annular lip 24 and across from the depressed longitudinal contacts 26 as shown in figure 3. The spring finger 30 thus biases a mating pin terminal (not shown) received in the socket 16 into engagement with the depressed contacts 26. The free end of the spring finger 30 preferably is spaced slightly from the inside surface of the rolled socket 16 to reduce the engage force required for insertion of the pin terminal. The spring finger 30 is also tapered slightly in the longitudinal direction as shown in FIG. 4.

Figure 5:
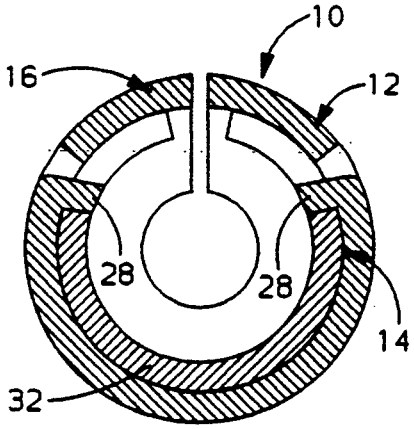
FIG. 5 is a transverse section of the electrical female terminal taken substantially along the line 5—5 of FIG. 1 looking in the direction of the arrows.

The spring member 14 is encapsulated in the rolled socket 16 and it is secured inside the rolled socket 16 circumferentially as well as longitudinally by the lanced tabs 28 so that the spring finger 30 is located halfway between the longitudinal contacts 26 in the circumferential direction, that is about 120 degrees from each of them. More particularly, the spring member 14 is secured inside the rolled socket 16 by the lanced tabs 28 being bent inwardly to protrude through slots in the edges of the c-shaped collar 32 as shown in FIGS. 3 and 5.

Even though the rolled socket 16 is lanced to provide the contacts 26 an the tabs 28, they are bent inwardly so that the improved electrical female terminal 10 has a round, protrusion free contact end that allows the terminal to be plugged through a tight hole of an elastomeric seal without damage to the elastomeric seal. Moreover, the base terminal 12 includes the rolled socket 16 as well as the crimp wings 18 and thus can be advantageously made of soft formable material that suits the particular forming needs of this piece. The base terminal 12 also provides the electrical contacts 26 for the pin terminal as well as the crimp wings 18 for attaching the terminal to the cable so that the electrical interfaces of the terminal are minimized.

Furthermore, the spring member 14 has the singular function of providing the spring member so that it can be made of a material having optimum spring characteristics, such as spring steel. The spring member 14 is also encapsulated in the roller socket 16 so that the spring member 14 does not have any exposed portion that can damage an elastomeric seal when the terminal 10 is plugged through a tight hole in the elastomeric seal.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical female terminal (10) of two piece construction comprising a base terminal (12) and a spring member (14);

the base terminal (12) being stamped and formed from a blank strip of relatively soft copper alloy and including a round, smooth, protrusion-free contact end in the form of a rolled socket (16) that is attached to crimp wings (18) by an intermediate cylindrical neck (20) of a rolled cylindrical form;

the rolled socket (16) having an annular lip (24) at its front end defining an entrance for plugging a terminal pin into the socket (16) and a pair of longitudinal contacts (26) near the front end that are lanced from the material of the socket (16) and depressed inwardly in the form of simple beams that are integrally attached to the rolled socket (16) at each end and that have depressed flat center sections that lie radially inwardly of the annular lip (24);

the longitudinal contacts (26) being approximately 120 degrees apart in the circumferential direction and equally spaced on either side of a seam of the rolled socket (16), the rolled socket (16) further including a pair of lanced tabs (28) in its rear portion that are bent inwardly to secure the spring member (14) in place, the spring member (14) being encapsulated in the rolled socket (16) and being stamped and bent from a sheet of spring steel into a generally T-shaped configuration comprising a single spring finger (30) that is attached to the middle of a c-shaped support (32) at one end, the spring finger (30) being bent in the longitudinal direction to provide a raised apex (34) located across from the depressed longitudinal contacts (26);

the spring member (14) being secured inside the rolled socket (16) by the lanced tabs (28) so that the spring finger (30) is halfway between the longitudinal contacts (26) in the circumferential direction; and the lanced tabs (28) being bent inwardly to protrude through slots in the edges of the c-shaped support (32) to secure the spring member (14) in place.

2. An electrical female terminal (10) of two piece construction comprising a base terminal (12) and a spring member (14);

the base terminal (12) being stamped and formed from a blank strip of relatively soft copper alloy and including a round protrusion-free contact end in the form of a rolled socket (16) that is attached to crimp wings (18) by an intermediate cylindrical neck (20) of a rolled cylindrical form;

the rolled socket (16) having an annular lip (24) at its front end defining an entrance for plugging a terminal pin into the socket (16) and a pair of contacts (26) near the front end that are formed from the material of the socket (16) and depressed inwardly to provide contact portions that lie radially inwardly of the annular lip (24);

the spring member (14) being stamped and bent from a sheet of spring steel into a generally T-shaped configuration comprising a single spring finger (30) that is attached to the middle of a c-shaped support (32) at one end, the spring finger (30) being bent in the longitudinal direction to provide a raised portion across from the contacts (26);

the spring member (14) being located entirely inside the rolled socket (16) by deformed portions (28) of the rolled socket (16) engaging the c-shaped collar (32) so that the spring finger (30) biases a terminal pin inserted into the rolled socket (16) into engagement with the contact portions (26).

3. An electrical female terminal (10) of two piece construction comprising a base terminal (12) and a spring member (14);

the base terminal (12) being stamped and formed from a blank strip of relatively soft and formable electrically conductive metal and including a round, protrusion-free contact end in the form of a rolled socket (16) that is attached to crimp wings (18) by an intermediate cylindrical neck (20) of a rolled cylindrical form;

the rolled socket (16) having an annular lip (24) at its front end defining an entrance for plugging a terminal pin into the socket (16) and at least a pair of contacts (26) near the front end that are formed from the material of the socket (16) and depressed inwardly to provide contact portions that lie radially inwardly of the annular lip (24);

the spring member (14) being stamped and bent from a sheet of spring metal and having a spring finger (30) that is attached to a support (32) at one end, the spring finger (30) being bent in the longitudinal direction to form a raised portion located across from the depressed contacts (26); and the spring member (14) being located inside the rolled socket (16) by portions (28) of the rolled socket (16) engaging the support (32).

* * * * *